US006736398B2

(12) United States Patent
Stanton

(10) Patent No.: US 6,736,398 B2
(45) Date of Patent: May 18, 2004

(54) MODULAR BOARD GAME APPARATUS

(76) Inventor: Jaan Peter Charles Stanton, 8 Chalkhill Rd., Norwich (GB), NR1 1SL ( * ) Notice: Subject to any disclaimer, the term of this patent is extended or adjusted under 35 U.S.C. 154(b) by 0 days.

(21) Appl. No.: 10/141,547

(22) Filed: May 8, 2002

(65) Prior Publication Data

US 2002/0167129 A1 Nov. 14, 2002

(30) Foreign Application Priority Data

May 8, 2001 (GB) ..... 0111200

(51) Int. Cl.[7] ..... A63F 3/00

(52) U.S. Cl. ..... 273/283; 273/282.1; 273/284; 273/285; 273/287

(58) Field of Search ..... 273/241, 282.1, 273/282.2, 283, 284, 287, 285

(56) References Cited

U.S. PATENT DOCUMENTS

| | | | | |
|---|---|---|---|---|
| 872,923 A | * 12/1907 | Ford | ..... | 273/261 |
| 4,058,318 A | 11/1977 | Thomas et al. | | |
| 4,696,476 A | 9/1987 | Eplett | | |
| 5,370,397 A | * 12/1994 | Miller et al. | ..... | 273/283 |

FOREIGN PATENT DOCUMENTS

| | | |
|---|---|---|
| DE | 3305673 | 8/1984 |
| FR | 2 357 277 | 9/1976 |
| GB | 2 028 668 A | 3/1980 |
| GB | 2 185 843 A | 7/1987 |
| GB | 2 202 453 A | 9/1988 |
| GB | 2 211 749 A | 7/1989 |
| GB | 2 316 330 A | 2/1998 |

* cited by examiner

*Primary Examiner*—Benjamin H. Layno
*Assistant Examiner*—Vishu K Mendiratta
(74) *Attorney, Agent, or Firm*—King & Jovanovic, PLC

(57) ABSTRACT

A modular board game apparatus has a segmental playing surface comprising pairs of segments which are variously configured to provides a surface whose shape and playing area may be changed according to the requirements of a particular game. The segments facilitate versions of games normally only played between two players (such as chess and draughts) to be played by two, three or four people (Configurations II, III and IV). The board shapes described are each proportional in area to the number of players, are symmetrical, and may be variously patterned (6,7). A preferred embodiment comprising eight quadrilateral segments (3) that may be arranged in differing orientations, assembled and secured about a central point by means of a restraining ring (2) is illustrated. Segment sets comprising variously shaped segments of differing thickness can be assembled to simulate undulating terrain.

11 Claims, 13 Drawing Sheets

MODULAR BOARD GAME APPARATUS

FIELD OF THE INVENTION

The present invention relates to a board game apparatus and particularly to a board game apparatus having a playing surface of the type which includes outermost edges defining the range of movement of the playing pieces, the surface providing the area on which the playing pieces (and other apparatus used to play a game) may be placed and/or moved.

The invention more particularly relates to a board game apparatus having a playing surface whose dimensions can be changed in order to suit the requirements of a particular game, such as the addition of extra players, thereby seeking to replace the traditional, square (often chequered) or rectangular games boards in current use.

BACKGROUND OF THE INVENTION

The term "board", "layout", "playing surface" and "playing area" as used interchangeably herein are intended to indicate the major plain, patterned, illustrated or otherwise ornamented surface on which a game is played. The terms are not intended to be used in a limiting manner and no such interpretation is to be taken or inferred.

The "playing surface" need not be limited to a physical embodiment and the corresponding representations of the playing surface on a television or computer screen are included within the intended scope of the invention.

Square game boards (particularly square, chequered boards) are common and even board games that are of a distinctive design are often contained within the confines of a folding square board. Making a games board that is "different" is often the single most important factor in determining the success or otherwise of a new board game.

The square board is universally known and the established board format of many traditional board games for two players. The chequered board is a most common variant but other patterns and surface ornamentations are known. Of these traditional games many, particularly two player games such as chess, checkers and backgammon are inevitably limited by the surface on which these games are played. Even board games that do not rely on the checkerboard often use a folding square board on which to play the game. Attempts at changing the board format of two player board games in order to accommodate additional players are well know. The exposition below necessarily concentrates on the efforts made to adapt the games of chess, checkers and backgammon in this fashion. However, each idea proposes a solution only to one associated problem. To date there has been no universal system for the general adaptation of two player boards to boards suitable for games between two or more players.

Three and four player versions of board games traditionally played by two people (such as chess and draughts) are known. However, a different board must be purchased for each eventuality (that is, two, three or four players), a disincentive to those people who may only wish to purchase one board. The alternative, to buy a larger board accommodating greater numbers of players, has its drawbacks. Such boards are often cumbersome and, if fewer than the maximum number sit down to play, may require asymmetric starting positions (where one or other player has a decisive advantage) or protracted play in view of the larger area to be covered. Such boards may also require the use of non-traditional playing pieces and/or associated rules far removed from the original game it seeks to emulate.

In order to add variety to games like chess and checkers numerous adaptations to the traditional chequered board have been proposed. There have been vertical boards, three-dimensional boards, and a variety of folding and boxed arrangements. Of background relevance to the disclosure of the present invention, U.S. Pat. No. 4,147,362 (Fisher, 1979) proposes a chess board made of cubes having on each face a printed chess piece or coloured square. During the course of a game, the cubes are orientated in a manner which places the intended piece or empty square uppermost. U.S. Pat. No. 3,406,975 (Berger, 1968) divides the chessboard into sections and provided additional sections on which captured pieces are optionally placed in their respective starting positions to facilitate faster game piece set up in subsequent games. U.S. Pat. No. 4,696,476 (Eplett, 1987) divides the chessboard into quadrants which, using squares of a different height, are relocatable to form 'mountain' and 'valley' landscapes. U.S. Pat. No. 5,048,840 (Johnson, Jr., 1991) envisages a more complex game board building apparatus comprising interlocking square columns which are constructed to various heights thereby allowing a wide variety of 'contoured' game surfaces to be assembled.

In the above disclosures, the rules of chess remain unchanged and whether each innovation actually adds to the enjoyment of the game or merely detracts therefrom remains a matter of opinion. More notable modifications to the chequered board require significant departures from the rules of chess thereby spawning ideas for new games. U.S. Pat. No. 3,794,326 (Bialek) employs a die to introduce the element of chance. U.S. Pat. No. 1,955,795 (Ekbom, 1934) divides the playing surface into component rows which are swappable. U.S. Pat. No. 4,903,969 (Williams, Jr., 1990) describes a board in which the squares themselves can be removed.

Many chessboards comprising two or more playing surfaces have come into existence. U.S. Pat. No. 5,033,751 (Ching, 1991) proposes a pyramidal chess-like game whilst U.S. Pat. No. 4,504,060 (Riuhiluoma et al., 1985) envisages a two-tier board and 'obstructed' squares. The chequered board itself has also been 'disassembled' and used as the basis of many challenging puzzles. U.S. Pat. No. 5,868,388 (Wood, et al., 1999) uses a checkerboard on each side of a puzzle that must be constructed from component polyminoes.

Despite all this endeavour, few ideas have approached the enduring popularity of chess in its purest form. Chess is complex enough without making it more so and variety already exists in the many offshoots of the game, mainly those based on new sets of rules (such as games that start with fewer pieces). Most devotees are not persuaded by games that purport to be chess but clearly are not. There is an exception, however, in that multiple-player chess and checkers continue to 'tweak' the interest of players and new boards designed to accommodate more than two players are numerous. David Pritchard's *Encyclopedia of Chess Variants* lists thirty-one versions of three-player chess alone, the earliest of which dates back to 1765.

Players accept that the board and certain elements of the rules of the game must be modified to accommodate extra participants but wish for the necessary changes to be as unobtrusive to the spirit of the original game as possible. Board games that are far removed from recognisable chess include U.S. D. 55,455 (Day, 1920) which extends the square chequered playing field on each side by a depth of three squares to form a 'cross' shape. U.S. Pat. No. 694,509 (Winckfield, 1902) uses a similar board shape with rules akin to checkers. U.S. Pat. No. 511,306 (Moore, 1898)

makes some attempt to keep to the rules of chess and checkers. The board, which requires assembly, employs four "tongue and groove" extensions (one on each side of a checkerboard) to convert it into a board for three and four players. U.S. Pat. No. 5,125,666 (Adams, 1992), U.S. Pat. No. 5,275,414 (Stephens, et al., 1994), U.S. Pat. No. 5,513,849 (Navin, 1996), U.S. Pat. No. 5,586,762 (Wearley, 1996), U.S. Pat. No. 6,102,399 (Kifer, 2000) and others all employ very similar boards with each game version being distinguished from the other by subtle rule changes.

All of the boards referred to above suffer from being overly large. Furthermore, the central 8×8 square arena remained, for the most part, unaltered and at the start of play, chess pieces were placed adjacent to one another at right angles. This required the pieces to interact with one another quite unnaturally. As the number of players round the board increased so too did the playing area but in a manner which was disproportionate to the number of players. Games have been lengthy as a consequence. A further problem of the 'cross' shape is that, when used by three players, the relative starting positions are only symmetrical in one direction thus affording one or other player an advantage in space and time during a game. Perhaps the most insuperable problem is the question of how a pawn might move 'forward' in a game with three or four players. Moore attempted to solve this by having the pawn move one square orthogonally in any direction once in the middle of the board, thereby changing the whole character of the game.

Considerations such as those above have ensured that such hybrid games have not won general approval amongst chess purists. However, further attempts have been made to refine the multiple-player board in order to overcome these problems particularly in relation to three-player games. In 1843, Tesche proposed an irregularly shaped checkerboard in which the starting position of two of the three players was 'staggered'. Attempts at making the three-player board more symmetrical followed. A three-player game in U.S. Pat. No. 5,158,302 (Rewega, 1992) and a multi-player game in U.S. Pat. No. 5,582,410 (Hunt, 1996) both use a board comprised of hexagons (of which there are many examples) and employed three Bishops per side. Henry Self's 1895 version arranged three square chequered boards around an equilateral, triangular-shaped 'void'. In U.S. Pat. No. 4,249,741 (Buijtendorp, 1981), there is likewise arranged three sides of a board at 120° to each other, 'part-filling' the void in the middle of the board by expanding the chequered pattern using concentric arcs. U.S. Pat. No. 5,209,488 (Kimball, 1993) discloses a part-filled void with elongated 'squares', whilst U.S. Pat. No. 4,653,759 (Anderson et al, 1987) employs hexagons in the middle of the board.

The principle of distorting the playing surface 'squares' in order to accommodate the new board shapes and allow for more natural play became established in the 1980's, especially for three-player boards. As disclosed in U.S. Pat. No. 4,190,254 (Leeds, 1980) a 'double chess board' was designed using concentric arcs and contained an octagonal void in the centre through which Queens and Bishops could pass 'choosing' one of two alternate routes. In U.S. Pat. No. 5,908,193 (Houman, 1999) a similar board shape is disclosed but the game used the device of placing King and Queen on the same square at the commencement of play so reducing the length of that side to seven 'squares'.

Despite the huge array of alternative designs not one is able to offer concurrent solutions to the three problems of symmetry, conservation of playing area and player number adaptability. Add more players and the board becomes too large—reduce the size of the playing area and the symmetry is lost—design a symmetrical board and only a set number of players can participate.

Such dilemmas are not confined to the conversion of chessboards to more players. Conversion to multiple player versions of other traditional two player games such as backgammon have encountered similar problems. U.S. Pat. No. 4,496,157 (Gilliland, 1985) and U.S. Pat. No. D. 360,232 (Ecer, 1995) both describe versions of three player backgammon whilst in U.S. Pat. No. 4,058,319 (Thomas et al., 1977), U.S. Pat. No. 4,342,458 (Lane et al. 1982) and U.S. Pat. No. 4,549,739 (Tobin et al., 1985) versions are disclosed for two to four players. U.S. Pat. No. 5,370,397 (Miller Jr. et al., 1994) proposes a game of backgammon using interchangeable surface inserts to suit the many variants of the game which exist. Although the problems were not so acute, larger backgammon boards designed to cater for up to four people inevitably required that not all of the board is used when fewer than the maximum permitted number sit down to play. The wasted space is not only aesthetically displeasing but if actually utilised means that games are of uncharacteristic length.

Despite the world-wide appeal of games like chess and the rise in popularity of multiple-player versions of this and other games, it is almost certainly the absence of a definitive board allowing for "natural" play that ensures this genre is not yet universally accepted. A single, versatile playing surface whose shape and area could be changed, either at the beginning or during the course of a game, would not only allow for the easy adaptation from two to more players but be the focus of a new generation of board games based on this principle.

Although many games seek to reproduce the strategy behind a real or imagined battle, the board game version is invariably played out on a flat, sometimes featureless, surface. It is impossible, when using a single board, to reproduce the effects of a varied terrain or an undulating landscape and then change this landscape to suit the parameters of a new battle at will. Increasingly board games are loosing ground to computer games that appear to offer limitless variety but at the cost of human interaction.

The exemplifying examples described hereinabove have been chosen for illustrative purposes only and are not intended to limit the scope of the present invention which allows many more traditional games to be modified, as well as providing a versatile games board system for games which have yet to be devised.

It is an object of the present invention to seek to alleviate the above disadvantages and to provide a board game apparatus having a playing surface and/or boundary shape which can be changed.

It is further an object of the invention to provide a board whose playing surface more accurately simulate the terrain encountered in a real or imagined battle.

It is a yet further object of the invention to provide a board that, for games such as chess, draughts (checkers) and backgammon, is easily configured for more than two players and which is proportional in playing area, compact, symmetrical and affords "natural" play.

SUMMARY OF THE INVENTION

Accordingly, the present invention provides a board game apparatus having a playing surface which comprises pairs of segments which are variously configurable so as to form a plurality of board layouts for two or more players, the pairs of segments being reflective pairs having identical included angles and edge lengths.

The provision of reflective segment pairs facilitates the simple configuration off a variety of board layouts within a single board game apparatus.

Preferably, the segments forming the pairs are quadrilaterals.

Advantageously, the segments are provided with a pattern or are otherwise suitably marked according to the requirements of a particular game.

Conveniently, the pattern or marking on a first one of a segment pair is the negative reflective image of the second segment of said pair.

It will be appreciated by the skilled reader that each one of a pair of board segments may be marked for a first game on one side (for example, chess) and for a second game on the other side (for example, backgammon).

In a preferred construction, the segments when assembled to form a playing surface for two, three or four players, provide a playing surface which is symmetrical in each of its multiple player configurations.

Advantageously, the area of the playing surface is proportional to the number of players for which the board layout is configured In a preferred embodiment, the playing surface comprises four mirrored pairs of eight quadrilateral segments of which each segment encloses opposite angles of 165° and 90°, and of 60° and 45°, and the sides subtended by the angle of 165° are of equal length.

In a further preferred embodiment, the playing surface comprises three mirrored pairs of six quadrilateral segments of which each segment encloses adjacent angles of 90°, defining two parallel sides and an intermediate perpendicular side, and further angles of 60° and 120°, the perpendicular side having a length equal to half the combined length of the parallel sides.

Conveniently, securing means are provided to hold the segments in their various configurations during play.

Preferably, the securing means comprises a retaining ring or collar. Optionally, magnetic strips or elements are fixed to or imbedded into selected regions of the edges of each segment.

Advantageously, at least one of the segments includes raised lands to provide a playing surface having various levels or 'terrain' over which playing pieces operably move. More particularly, said at least one segment is variably profiled with crests and troughs to provide a playing surface having various levels or 'terrain' over which playing pieces operably move.

This arrangement facilitates the simulation of undulating terrain encountered in a real (historical) or imagined battle.

The shape of the resultant playing surfaces may take many forms and will depend upon the shape and number of the component segments. Each segment may be two-dimensional or have three dimensions; resulting in a board which, once assembled, forms a flat surface or a surface comprised of different levels over which the playing pieces move.

The surface of each segment may be left plain or alternatively printed or otherwise suitably marked with a pattern (such as with checks or a grid) or howsoever marked according to the requirements of the board game.

A plain board is advantageously provided with a surface from which non-permanent inks are erasable.

The segments may be loosely joined (abutted) or held in their various playing configurations by means of catches or grooves on the edge of each segment; contained in a tray or, as is preferred; the playing surface is secured within a restraining outer band, ring or collar which may itself be folded for storage.

The board playing surface is of a size suited to the requirements of a particular board game. It is optionally manufactured from a thick cardboard with a printed pattern affixed or made of any other suitable material such as paper, cloth, plastics, glass, metal, plastics, ceramic, stone, wood or a combination of these. Metal-faced boards allow for magnetised playing pieces whilst the provision of surfaces which can be wiped would facilitate the use of non-permanent marker pens (for use, for example, in war games).

The metamorphic, corollar, gameboard described herein should be regarded as including both the physical pieces which make up the board and the representations of those pieces in the visual media such as television, video and on computer. It should also be recognised that the corollar shapes of the resulting segmental board configurations (howsoever embodied but particularly in relation to the configurations and the design patterns illustrated herein) might also be represented without the capacity to be reconfigured (i.e. printed on a conventional square board or set in a table top) but only insofar as such representations might be used to play a board game.

BRIEF DESCRIPTION OF THE DRAWINGS

The present invention will now be described more particularly with reference to the accompanying drawings which show, by way of an example only, five embodiments of board game apparatus in accordance with the invention. In the drawings:

FIG. 13 is a detailed plan view of a mirrored pair of game board segments of the fifth embodiment for use in multi-player games of chess, draughts (checkers) and the like.

DETAILED DESCRIPTION OF THE PREFERRED EMBODIMENTS

Herein described is a polymorphic/metamorphic, corollar gameboard system directed specifically towards the realisation of two, three and four player versions of two player board games. The term 'corollar' relates to the radially symmetrical nature of the playing surfaces and the flower-like shapes generated in each of the board's various configurations. A games board apparatus or set according to the invention comprises a plurality of discrete geometric shapes (petal-like segments) the edges of which may be variously joined or abutted to one another around a central point on a flat surface. Each segment encloses specific angles and when similar corners are orientated toward the centre of the resulting board a unique shape is generated. The shape and playing area of the resulting board can be changed by the simple addition or subtraction of its segmental components and by re-assembling the remaining segments with a different comer directed toward its centre.

More particularly, a modular array of game boards is realised by providing pairs of quadrilateral segments which are added to, or taken from, the array. This naturally affects the surface area of the board but more than this, the specific shape of the segments enables the overall shape of the board to be altered while maintaining the board's symmetry. It is the paired symmetrical nature of the segments which allows for games that do not favour one player/participant over another.

Paired quadrilateral segments are joined along a corresponding edge to form an intermediate shape or modular element, the addition or subtraction of which allows the surface area of the board to be matched to the number of people participating in a boardgame. A different board shape is created by re-arranging the segments into a different intermediate shape which when combined with other such shapes forms a different, symmetrically patterned board game layout.

Figure 1:
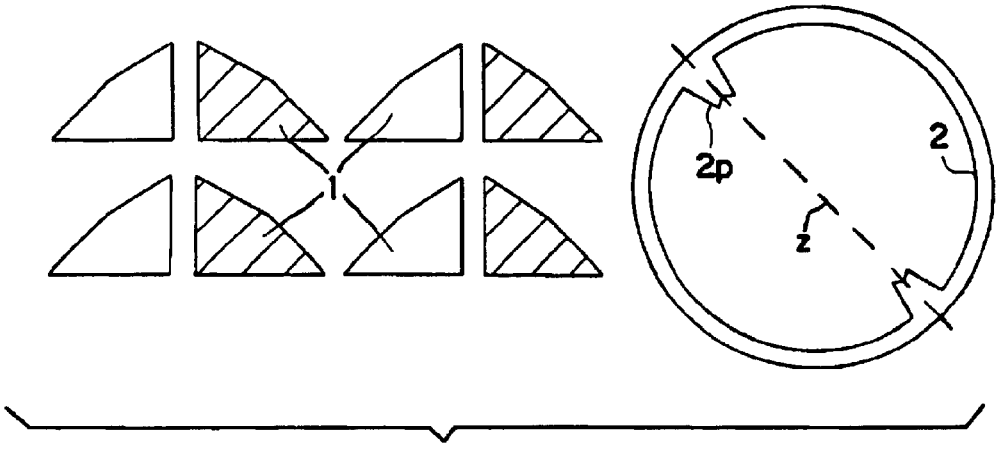
FIG. 1 illustrates component board game segments and a segment retaining ring in accordance with a first embodiment of the invention.

Referring now to the drawings and initially to FIG. 1, the board game apparatus comprises pairs of board segments, in this case, four identical pairs of eight quadrilateral segments 1 and a segment retaining ring or collar 2. The ring 2 includes profiled segment engagement prongs 2*p* which either abut an apex of an assembled playing surface or extend into a void formed at the interface of a two segments, as may be seen more clearly with reference to FIG. 5 below. The ring is foldable along an axis 'z' and the segments stackable for convenient storage.

Figure 2:
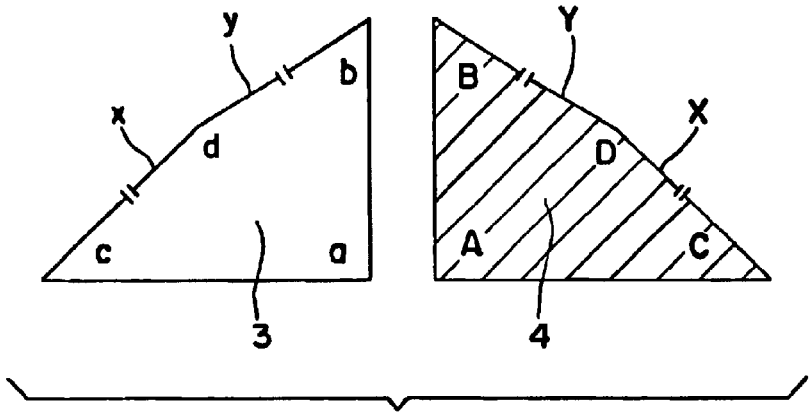
FIG. 2 is a detailed plan view of a pair of game board segments of FIG. 1.

In FIG. 2, the quadrilateral segments 1 are provided as a pair comprising a first segment 3 and its corresponding mirrored segment 4. For illustrative purposes, the first segment 3 will be considered a positive image and the second negative image segment 4 is shown hatched wherever it appears in FIGS. 1, 2 and 3*a* to 3*c*. Each quadrilateral segment is of a precise shape enclosing four angles.

In the explanation that follows, the following nomenclature is used: for the first segment 3 of the pair, small letters "a", "b", "c" and "d" indicate the inclusive angles and "x" and "y" are the lengths of two sides; for the second segment 4, capital letters "A", "B", "C" and "D" designate the identical inclusive angles and "X" and "Y" are the corresponding edge lengths.

As detailed in FIG. 2, an angle of 165° (d,D) lies opposite an angle of 90° (a,A), and an adjacent angle of 60° (b,B) is disposed opposite an angle of 45° (c,C). The angle of 165° subtends two sides (x,X; y,Y) of approximately equal length. The quadrilateral shape of each segment 3,4 may alternatively be described as being formed from a 165°, 7½°, 7½° isosceles triangle abutting, at its base, the hypotenuse of a 52½°, 37½°, 90° right angle triangle.

Figure 3A:
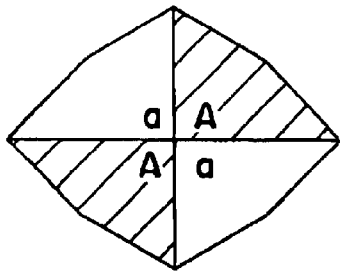
FIGS. 3*a* to 3*c* illustrate the orientation of pairs of segments of the first embodiment to form playing surface configurations departing from the standard square (Configuration I) layouts of the prior art and are labelled Configuration II, Configuration III and Configuration IV, for two, three and four player game boards, respectively.
Figure 3B:
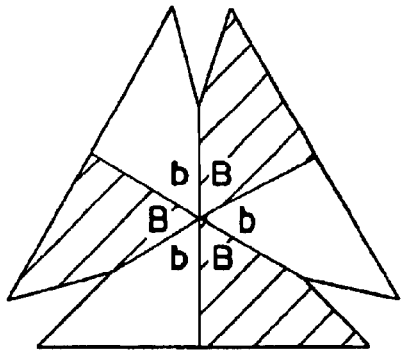
Figure 3C:
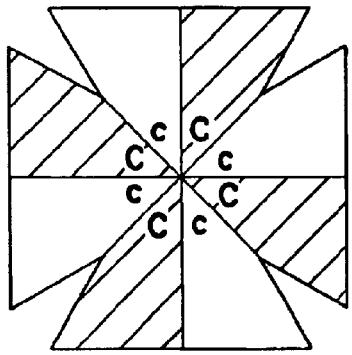

The segment pair 3,4 are joined together to form an intermediate shape which when combined with identical intermediate shapes facilitate the formation of game boards of the invention. Various combinations of these segment pairs are orientated (as intermediate shapes) according to the desired shape of the resulting board, the desired playing area or whether two, three or four people are to play. FIG. 3*a* illustrates how two pairs of segments may be assembled with the corners "a" and "A" alternately placed about a central point to form a two player board (Configuration II). FIG. 3*b* shows a three player board (Configuration III) comprising three pairs of segments 3,4 with the corners "b" and "B" alternately positioned about its centre. Likewise, as shown in FIG. 3*c*, a four player board (Configuration IV) uses all eight segments with the corners "c" and "C" positioned about a central point in the manner shown.

Figure 4:
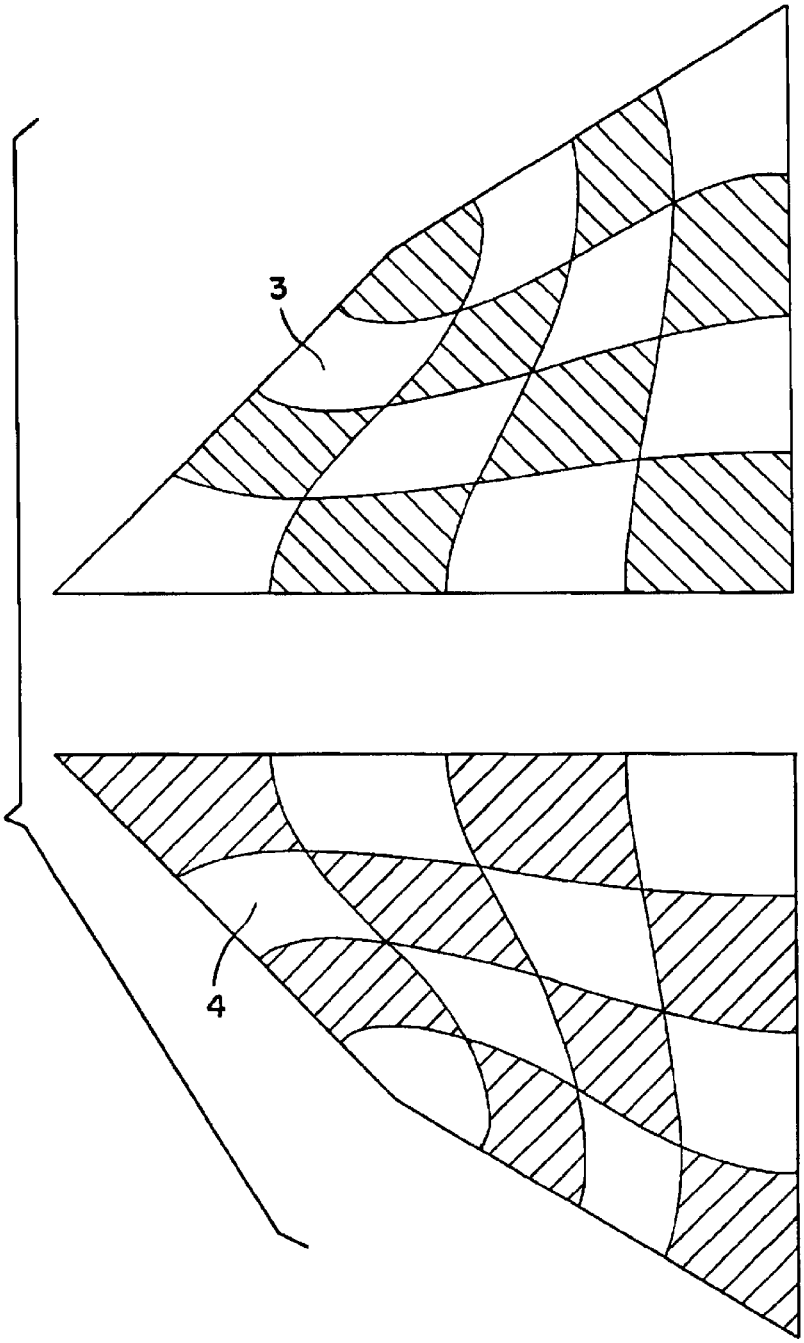
FIG. 4 is a detailed plan view of a patterned negatively mirrored pair of game board segments for use in multiplayer games of chess, draughts (checkers) and the like in accordance with the first embodiment.

The segments may be variously patterned. FIG. 4 shows a mirrored pair of segments 3,4 with a chequered pattern suitable for playing chess or draughts (checkers). The shape of each segment requires that the usual chequered pattern be modified. Here a grid or lattice comprised of curved lines has replaced the straight lines—used in the traditional square chequered board—to form 16 internal shapes (henceforth referred to as squares) on each segment. A chequered pattern is formed in the usual manner by the application of alternating contrasting colours to each of the 16 internal squares. The wavy chequered pattern so formed facilitates player visualisation of game piece movement. More particularly, the modified lines remove any angular conjunctions of lines between abutting segments and instead create a smooth continuation of the curved lines where segments join. The pattern of curves is observed in each of the board's three configurations. Note the mirrored pairing shows a chequered pattern in negative, that is, internal 'squares' are black (hatched) wherever a white square might otherwise be indicated (were its pairing a true reflected image) and likewise a white square wherever a corresponding black square appears.

Figure 5:
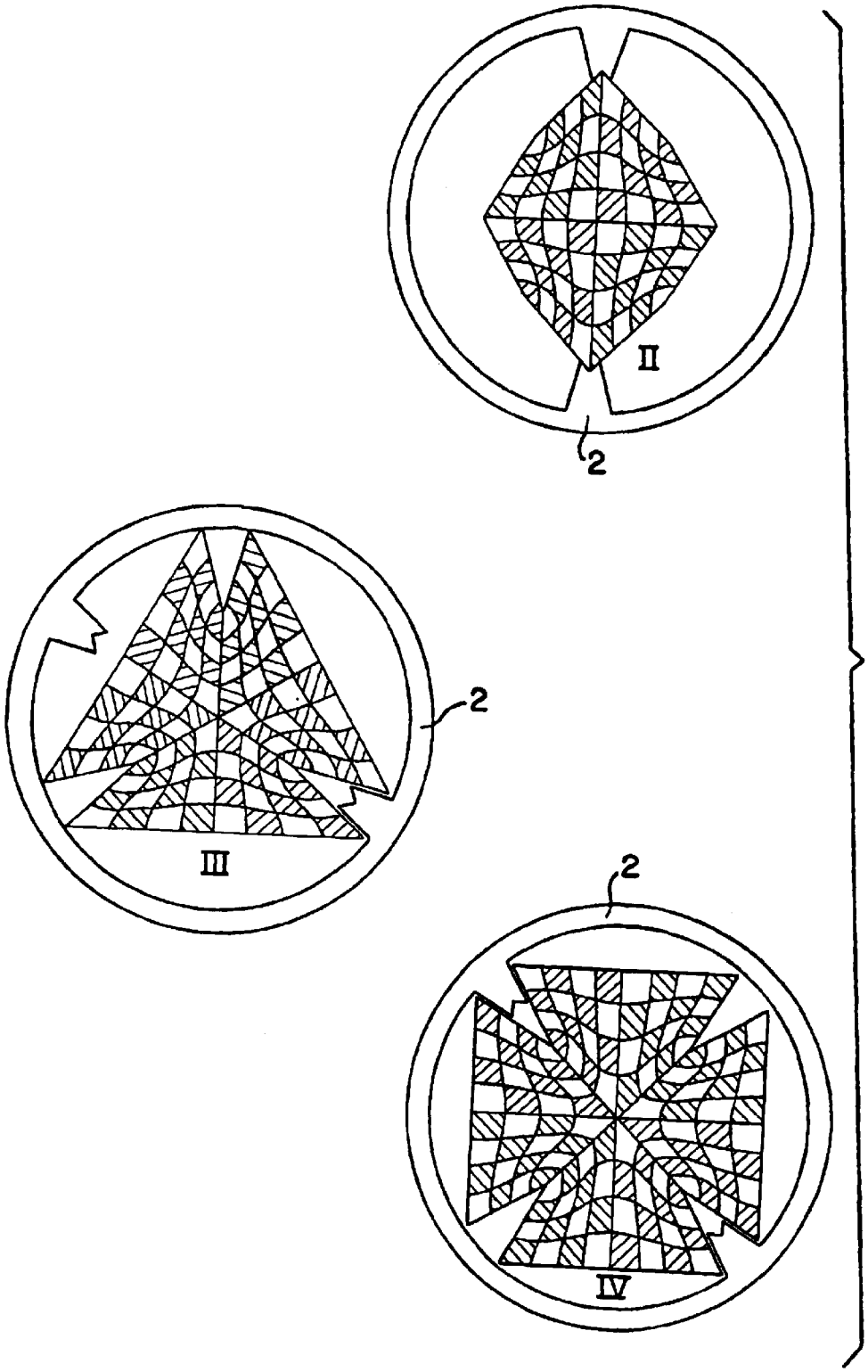
FIG. 5 illustrates the use of the segment retaining ring to hold Configuration II, Configuration III and Configuration IV board game layouts in place.

FIG. 5 shows the chequered segmental board in each of its three configurations II, III and IV contained within a single outer retaining ring 2. Configuration II allows two people to play a standard game of chess or checkers. Although the board shape and chequered pattern is somewhat distorted a game continues as though it were being played on a conventional square checkerboard.

Slightly modified rules for playing chess are required for the three and four player layout configurations III and IV simply in order to accommodate the or each additional player. The three and four player configurations do, however, allow for the usual number of playing pieces per side and employ the familiar starting arrangement. The rules governing the movement of each playing piece remain the same. If the movement of pieces over the distorted chequered pattern appears slightly unusual, the play is nevertheless entirely logical. There is no need for the addition of new playing units and play commences from the long straight edges of the assembled boards.

All three of the board configurations are symmetrical and of a surface area that is proportional to the number of players in a game. This leads to games of comparable character and length as in the traditional game it seeks to emulate.

Figure 6:
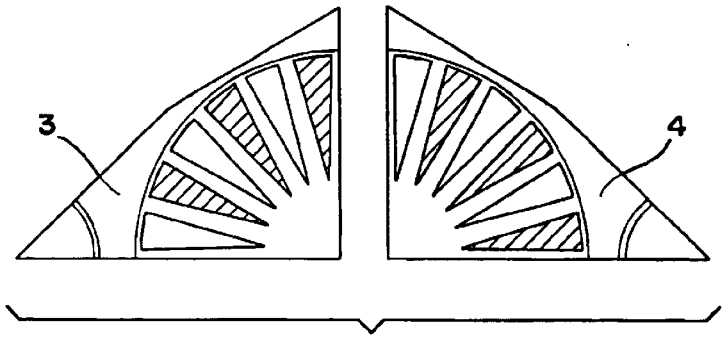
FIG. 6 is a detailed plan view similar to that of FIG. 4 in which a backgammon pattern is provided on a mirrored pair of segments in accordance with the first embodiment.
Figure 7:
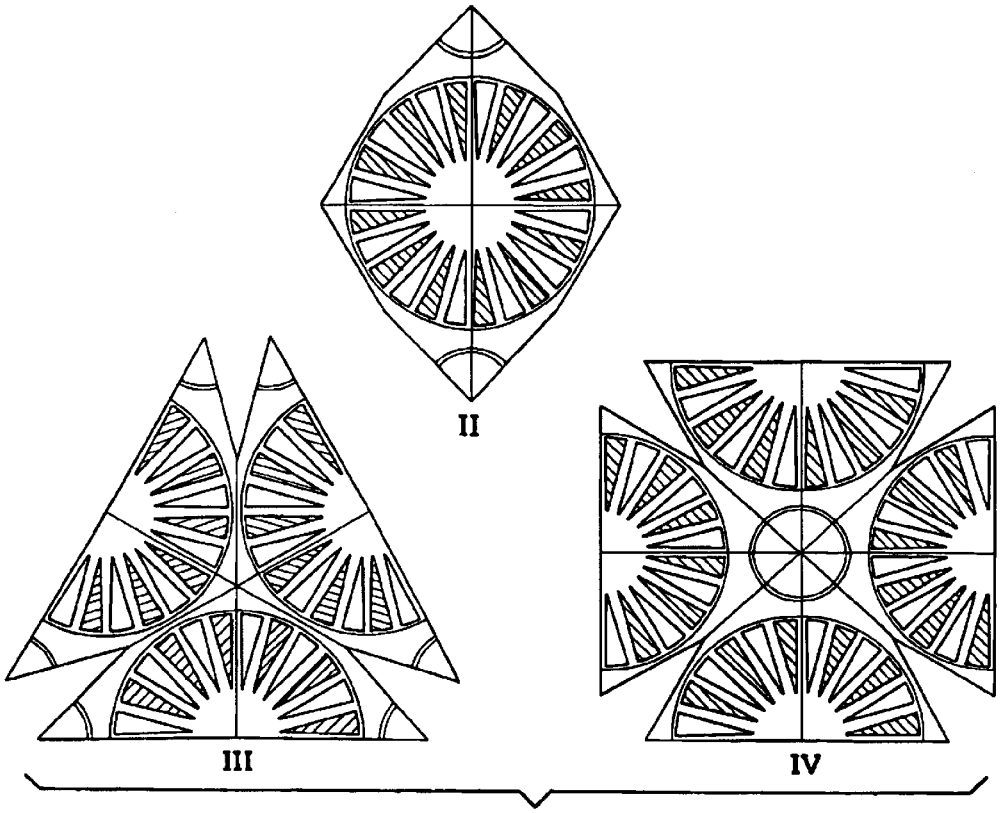
FIG. 7 illustrates the backgammon board in each of its three playing configurations.

The segmental games board illustrated herein is not restricted in use to the conversion of games like chess and checkers to their multiple player versions. FIG. 6 shows a mirrored pair of segments 3,4 with a pattern suitable for playing backgammon. Again the shape of each segment requires that the usual backgammon pattern be modified. Here the six points within each rectangular sector have been arranged within the confines of a quarter-circle. FIG. 7 illustrates each of the layouts for two, three and four player versions. Configuration II allows for a game of backgammon to be played by two participants using traditional rules. Games of backgammon between more than two players require that the rules of the game be modified. Configurations III and IV allow versions of this game to be played by three and four players respectively; each additional player's inner and outer tables being 'inserted' within the game board array. The number of additional points remains in proportion to the number of players as does the surface area of the board. This leads to games of a comparable nature to the original.

Figure 8:
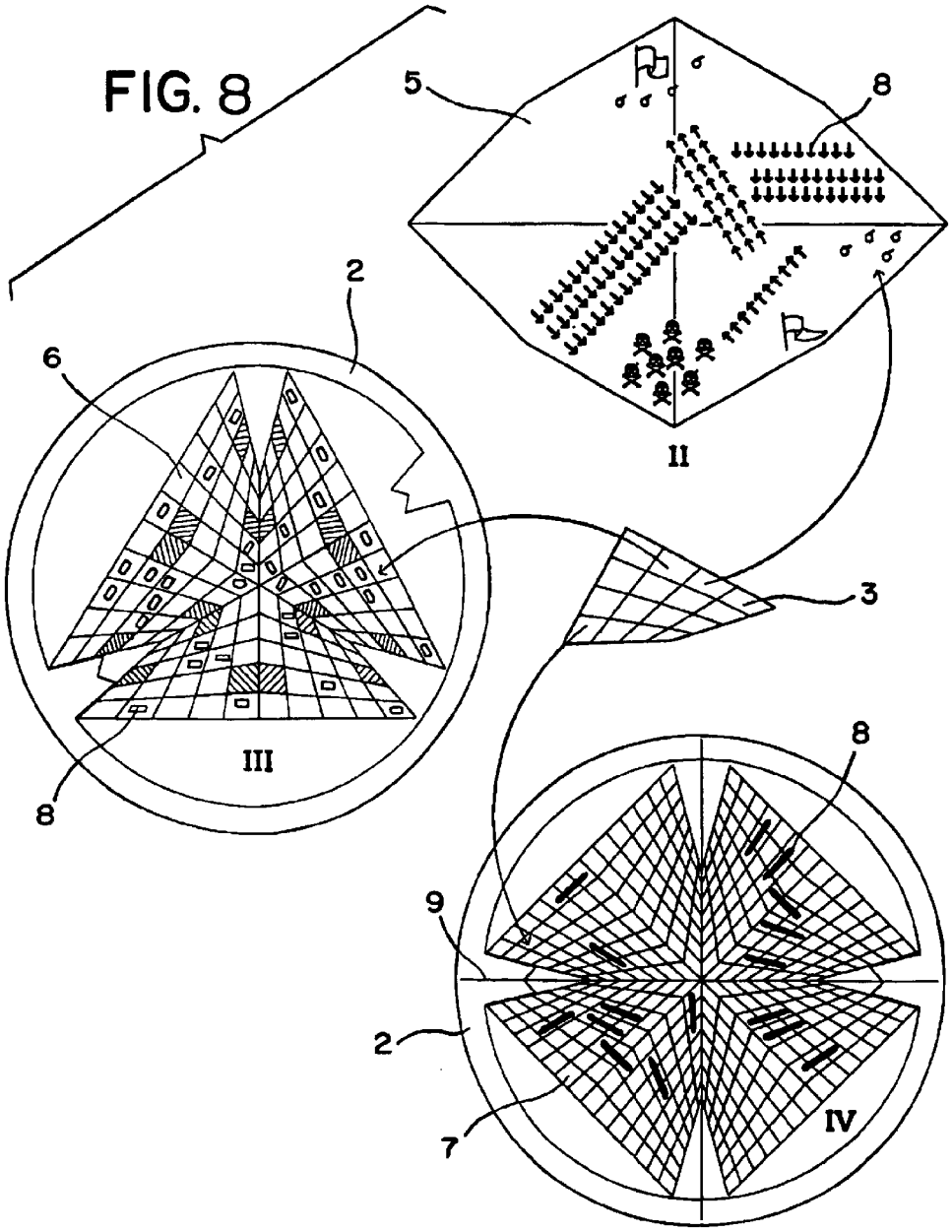
FIG. 8 provides illustrated examples of how the segmental board apparatus of the first embodiment might be used in other known board games.

Examples of the different categories of board game made possible by using the metamorphic, corollar games board as described herein are shown in FIG. 8. Each of the segmental board's three configurations (II, III and IV) has been used to illustrate just one example of a particular board game, respectively. Each of the board layouts (Configurations II, III and IV) may be reconfigured to allow the corresponding two, three or four player versions of the same game. Playing pieces 8 are shown as they might be placed in an actual game. The board surfaces may be left plain 5 or provided with a pattern 6,7. An example of the retaining ring 2 is shown for the Configuration III and IV, three and four player versions.

In FIG. 8, the 'Configuration II' arrangement illustrates a typical war game in which the surface of the board is left substantially plain. In such games the only restriction to the movement of any piece is the outermost edges of the assembled board and the rules governing play; there being no printed 'lines' restricting the movement of fighting units across the surface. Various configurations of the board are instead used to represent the 'shape' of the battleground or to reflect the relative size of the area over which a battle is fought. A 'Configuration IV' arrangement can be employed to represent the four cardinal points, for instance. The surface of the board is optionally such to allow the use of non-permanent marker pens in order to mark rivers, forests, minefields, etc. and the segments are conveniently of differing thickness in order to simulate hilly terrain.

The 'Configuration III' arrangement of FIG. 8 represents a three player game emulating a popular strategic board game. Games of this type typically require a player to start from one edge and to engage the second player towards the middle of the board. The movement of fighting units is restricted by a pattern printed on the board itself (typically a grid) and by the rules governing play. In most cases the use of the segmental board herein described allows the easy adaptation of these games from that of two players to versions for three and four players also.

With reference to the 'Configuration IV' arrangement, there is shown a game similar to the children's game of Battleships for four players. In such games players have a 'home territory' or 'zone' in which their pieces are either fixed in position or to which their pieces must return in order to win. The use of the metamorphic, corollar board herein described allows for the easy 'insertion' of additional players' zones within the game array itself. Note that any additional zone represents the minimum space required to introduce that player into the game and that the resulting playing area is both conserved and remains proportional to the number of players. Various accessories may be used as an adjunct to the board surface. Here a dividing screen 9 has been employed to visually separate each player's sector.

Having discussed particular arrangements/configurations of board games in connection with the segment pair of the first embodiment, attention is now directed to the general application of board construction with reference to segment pairs of a second, third and fourth embodiment.

It is necessary usually to build modular games boards on a flat surface without gaps or overlaps between adjacent segments. This imposes a limit on the number of geometric shapes which are useful in boards of the type disclosed in the present invention (boards with radial and rotational symmetry which can change their shape with the addition or subtraction of pairs of segments).

Figure 9A:
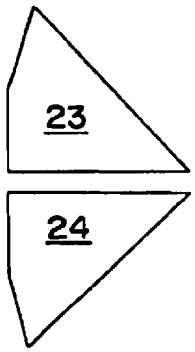
FIGS. 9*a* to 9*g* show in plan view a pair of board segments in accordance with a second embodiment of the invention, and the orientation of those segments to form Configuration II, Configuration III and Configuration IV board game layouts, for two, three and four player game boards, respectively.
Figure 9B:
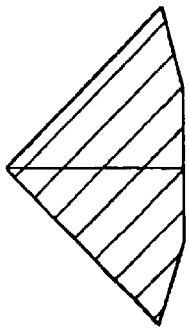
Figure 9C:
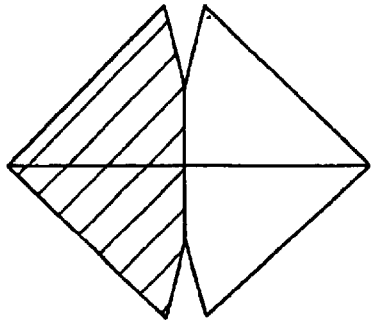
Figure 9F:
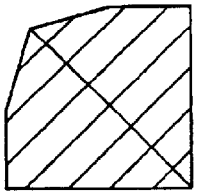
Figure 9D:
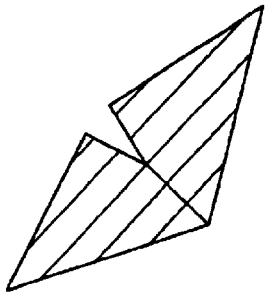
Figure 9G:
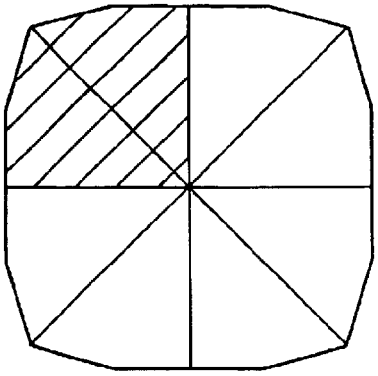
Figure 9E:
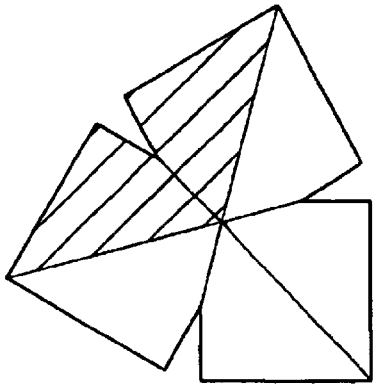
Figure 10A:
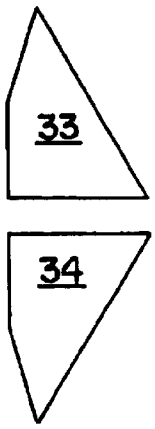
FIGS. 10*a* to 10*g* show in plan view a pair of board segments in accordance with a third embodiment of the invention, and the orientation of those segments to form Configuration II, Configuration III and Configuration IV board game layouts, for two, three and four player game boards, respectively.
Figure 10B:
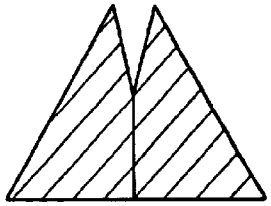
Figure 10C:
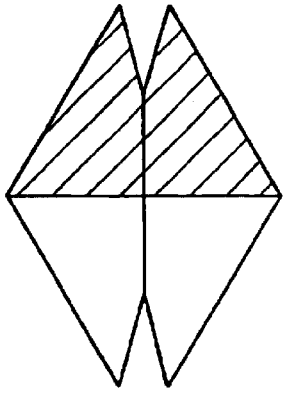
Figure 10D:
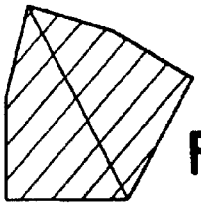
Figure 10F:
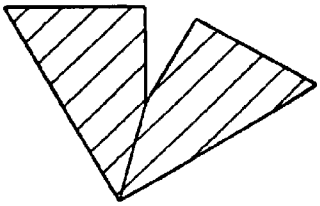
Figure 10E:
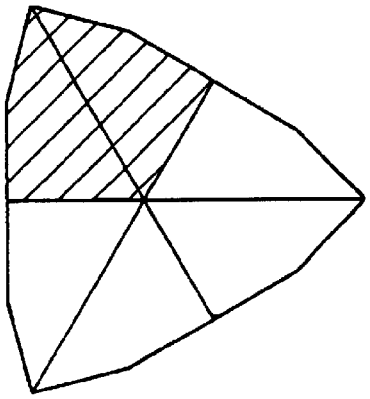
Figure 10G:
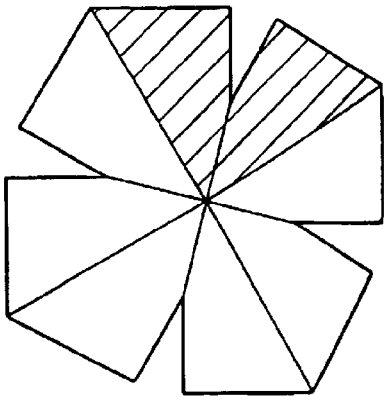

The pairing of segments is a crucial factor in distinguishing the group of segmental games boards herein referred to as metamorphic, corollar boards. By placing pairs of segments together along sides of equal length, such as the second and third embodiments of segment pairs 23,24,33,34 illustrated in FIGS. 9*a* and 10*a*, respectively, new intermediate shapes, as shown in FIGS. 9*b*, 9*d* and 9*f* or in FIGS. 10*b*, 10*d* and 10*f*, are created. A gameboard is completed by abutting two, three or four of these intermediate shapes against other similarly conjoined pairings in the manner shown in FIGS. 9*c*, 9*e* and 9*g* or 10*c*, 10*e* and 10*g*, respectively. Selection of a particular side of the segmental pair dictates the intermediate shape and the arrangement of successive ones of these intermediate shapes determines the board layout.

The overall shapes of the modular games boards are governed by the shape of their component segmental pairings (intermediate shapes) and in particular by the internal angles within each segment and the arrangement of those angles in relation to one another. FIGS. 9*a* to 9*g* and 10*a* to 10*g* show the second and third embodiments of two such board layouts (not patterned) in which the internal angles are the same but ordered differently. The various board shapes are produced in the manner described above.

Figure 11A:
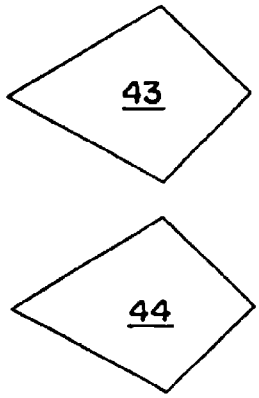
FIGS. 11*a* to 11*e* show in plan view a pair of board segments in accordance with a fourth embodiment of the invention, and the orientation of those segments to form Configuration II and Configuration III board game layouts, for two and three player game boards, respectively.
Figure 11B:
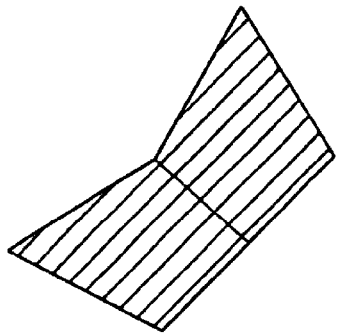
Figure 11D:
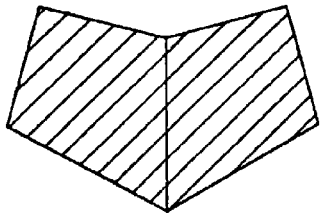
Figure 11C:
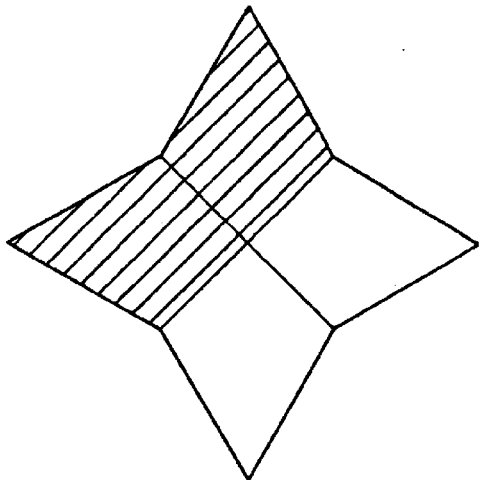
Figure 11E:
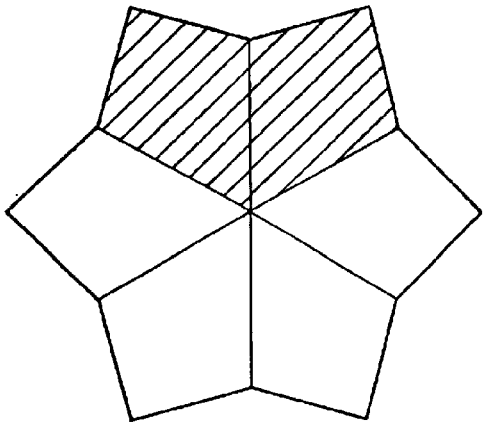
Figure 11G:
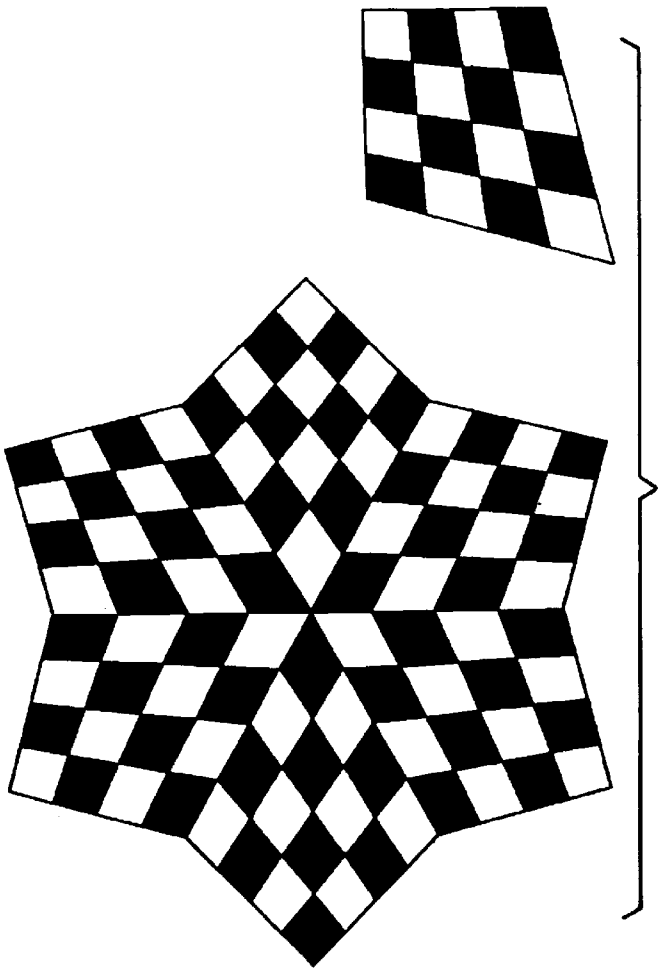
FIGS. 11*f* to 11*g* illustrate chequered Configuration II and Configuration III board game layouts using patterned board segments of the fourth embodiment.
Figure 11F:
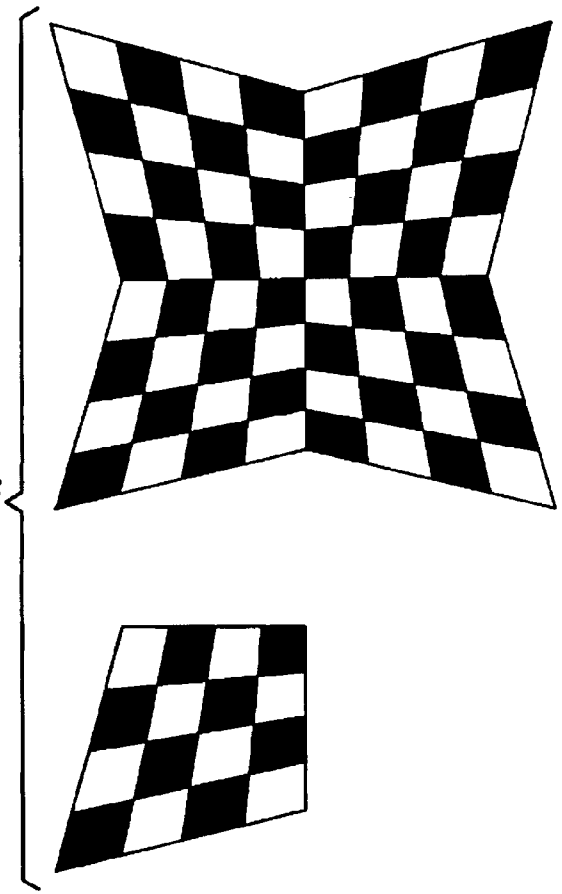

In the second and third embodiments, mirrored pairs of non-symmetrical segments 23,24,33,34 are provided which when combined form a unique intermediate shape (and hence gameboard) to be constructed from a given basic quadrilateral shape. However, in a fourth embodiment, where the segments are symmetrical, the resultant pairs of segments 43,44 may be identical as FIG. 11*a* illustrates. These identical segments 43,44 may then be arranged into two intermediate shapes, as illustrated in FIGS. 11*b* and 11*d*. These in turn give rise to the two distinctive board shapes of Configuration II and Configuration III layouts, as shown in FIGS. 11*c* and 11*e*, respectively. FIGS. 11*f* and 11*g* illustrate two practical arrangements resulting from the combination of the fourth embodiment of segment pair. Here a chequered pattern allows for games of chess or draughts for two or three players. The addition of a chequered pattern on the face of each segment differentiates the segments within a pairing. Segments will either have a white spine 43 or black spine 44.

The limitation of working on a flat plane (360°) dictates the internal angles of each segment and hence the overall shape of the board. The mirrored pairs of segments described must necessarily enclose a combination of at least two of the angles 90°, 60° and 45° in order to build symmetrical boards for two, three or four people.

Figure 12:
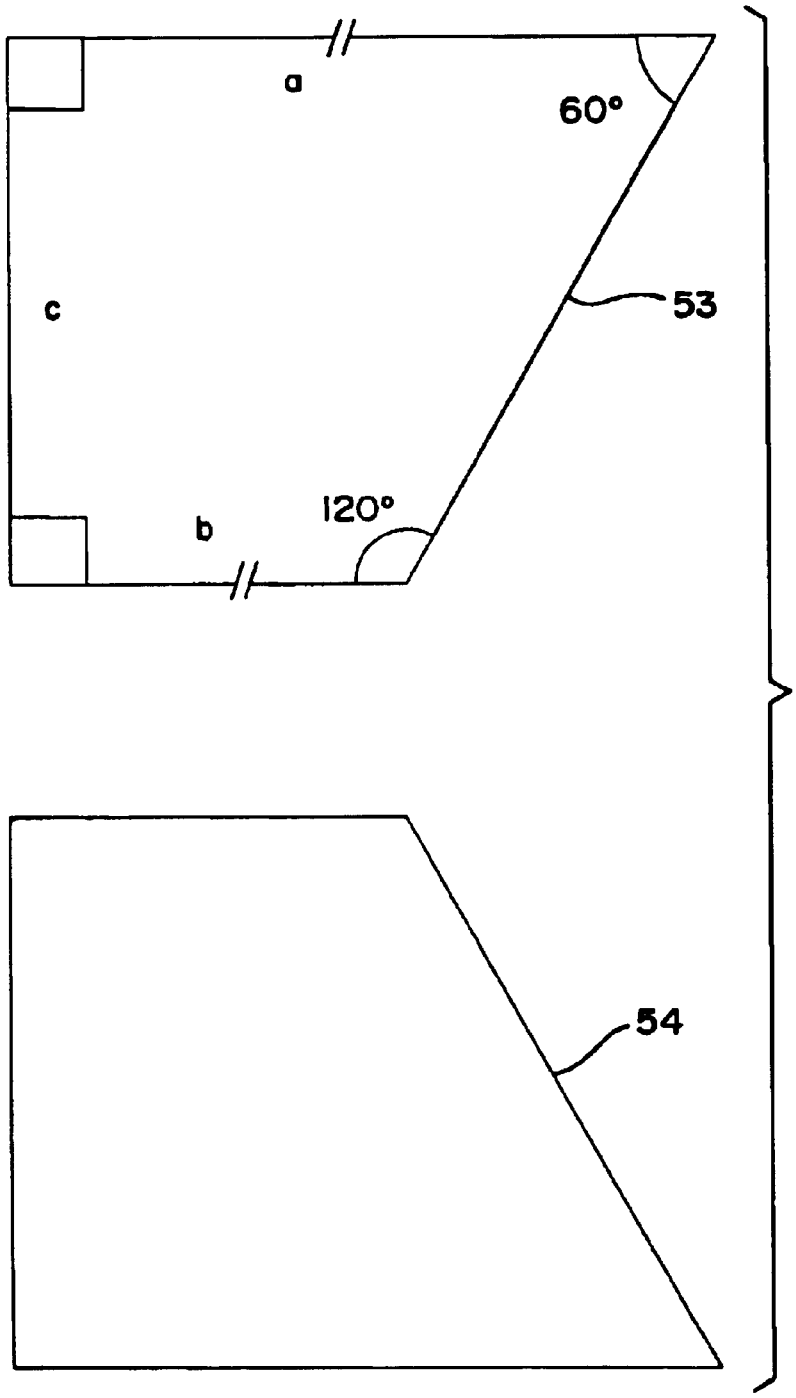
FIG. 12 is a detailed plan view of a pair of game board segments of a fifth embodiment.

A fifth embodiment of segment pair 53,54 is shown in FIG. 12, in which the geometric form of the pair of quadrilateral segments 53,54 have unique properties. Specifically, the shape encloses two 90° angles, a 120° and a 60° angle, thus, the sides 'a' and 'b' are parallel and the length of side 'c' is defined as (a+b)/2.

Figure 13:
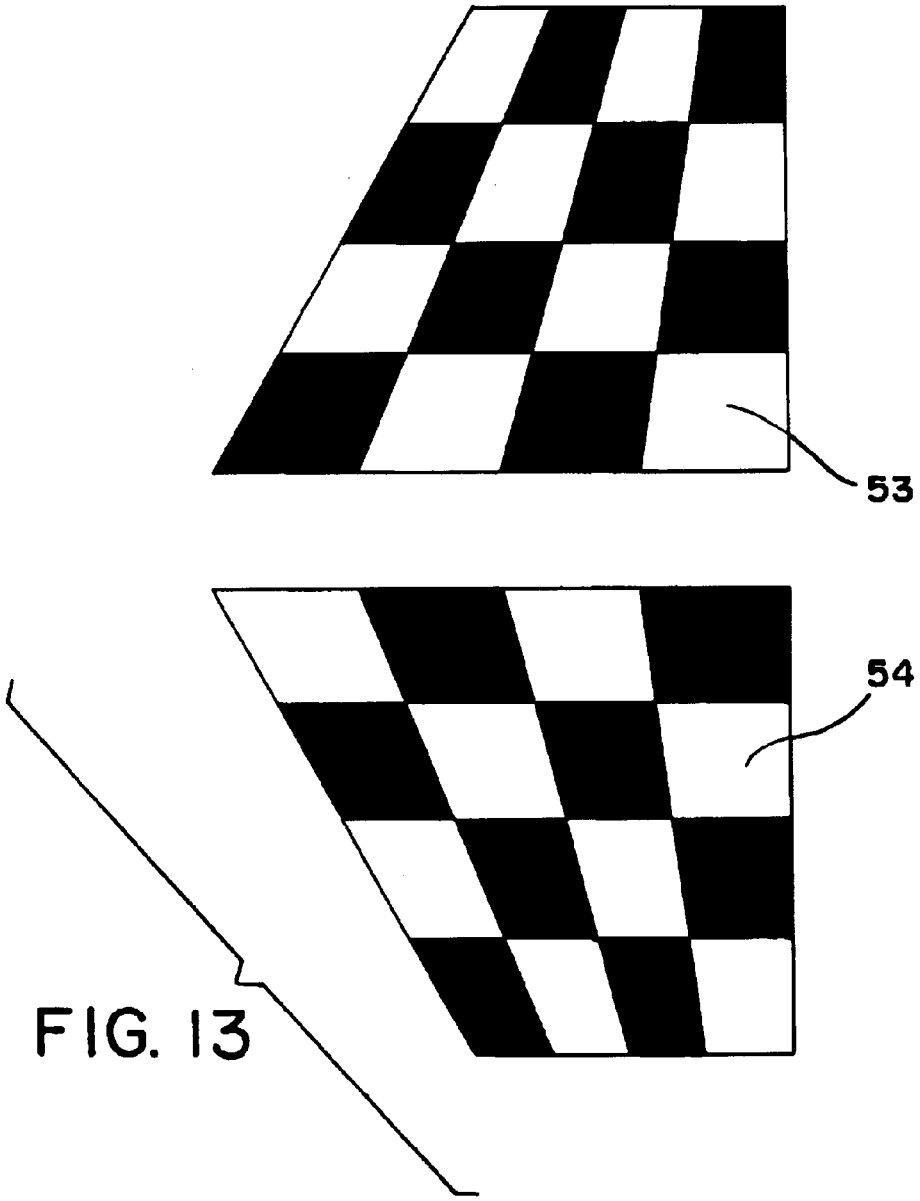

Using the shape of the fifth embodiment of segment pair and by applying a grid pattern of alternatively coloured 'squares' in the manner shown in FIG. 13, a chequered board may be created. By combining a segment pair with one or two other, a polymorphic gameboard is created that allows participants in a game of chess or draughts (checkers) for two or three players to begin from a straight edge.

This is wholly distinct from the boards shown in FIGS. 11*f* and 11*g* which do not have this property.

Figure 14A:
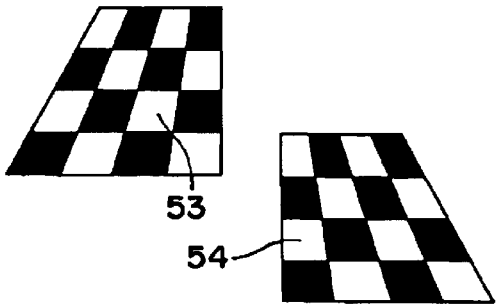
FIGS. 14*a* to 14*f* show in plan view a pair of board segments in accordance with the fifth embodiment of the invention, and the orientation of those segments to form four Configuration II layouts and one Configuration III layout, for two and three player game boards, respectively.
Figure 14F:
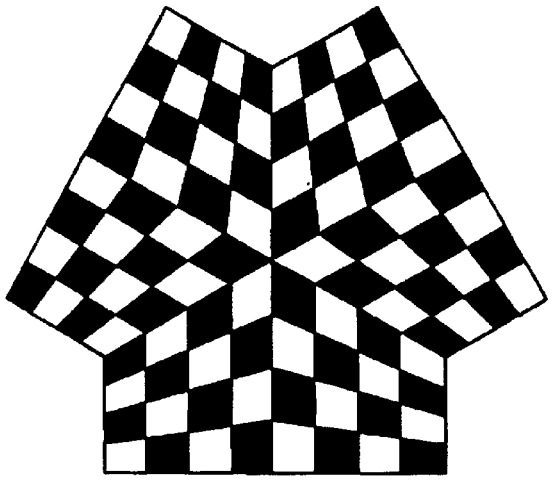

FIGS. 14*a* to 14*f* illustrate the configurations of polymorphic gameboard realised. Combinations of two pairs of segments 53,54 may be variously aligned to form chequered boards of Configuration II layout, as illustrated in FIGS. 14*b* to 14*e*. Similarly, three sets of the segmental pair 53,54 are combined to build a gameboard suitable for three players as shown in FIG. 14*f*.

Figure 14B:
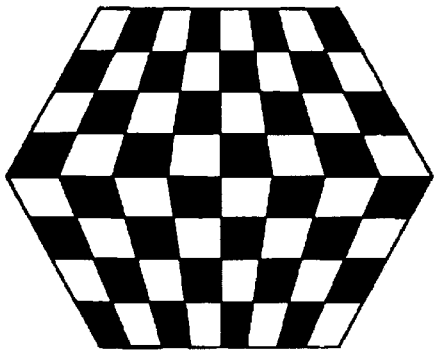
Figure 14C:
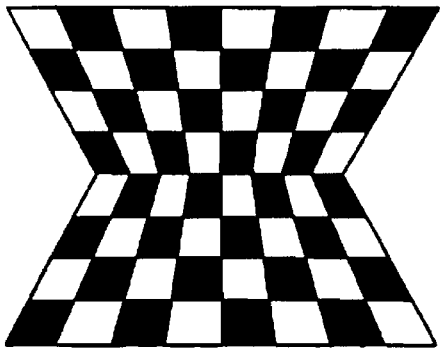
Figure 14D:
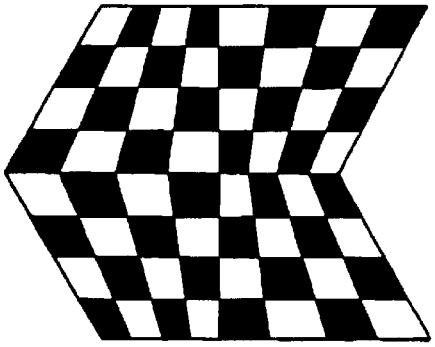
Figure 14E:
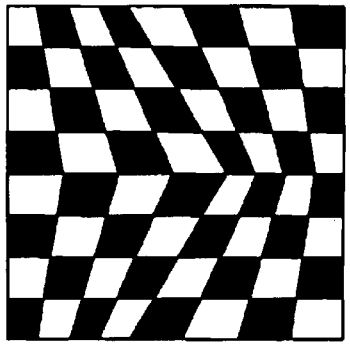

FIGS. 14*b*, 14*c* and 14*f* illustrate the manipulation of modular, corrolar shapes similar to those described previously in FIGS. 9*a* to 9*g*, FIGS. 10*a* to 10*g* and FIGS. 11*a* to 11*e*, the application of which to gameboard design forms the basis of the invention described herein. FIGS. 14*d* and 14*e* show how two pairs of segments may, in fact, be arranged without using symmetrical arrangements of corrolar forms whilst still producing suitable playing surfaces for two players. In the segmental arrangement shown in FIG. 14*d* both rotational and radial symmetry are lost. In the example of FIG. 14*e* it is the chequered pattern alone that looses this symmetry—the overall form of the board retains the familiar, square chess/drafts board shape. This latter embodiment of the polymorphic gameboard well illustrates the versatility of this apparatus in creating all manner of useful gameboard shapes.

Suggested Rules for Playing Multiple-player Chess using the Metamorphic, Corollar Gameboard Configuration II The board is used as one might the square chequered board with the white 'square' being placed to a player's right hand side. Queens are placed on their own colour and the normal rules of chess apply.

Configurations III and IV a) Chess pieces are placed against the long straight edges of the assembled boards on their familiar starting squares with the exception that the Queen is positioned to the left of her King.

b) Play commences with whoever is White moving first and continues in a clockwise direction.

c) The movement of chess pieces is dictated solely by the rules governing the movement of each unit. Whilst the moves appear distorted owing to the curved chequered pattern they remain entirely logical. In particular:

i. A straight line for a Rook is through whichever side of a square is opposite the side from which it entered. Orthogonal Rook lines curve away at segment junctions.

ii. The diagonal line for a Bishop is through whichever corner of a square is opposite the corner from which it entered. Note: in configuration 'III', a Bishop will change the colour of the square on which it stands when passing through the centre of the board. Bishop lines appear to bend or twist.

iii. The Queen combines the moves of the Rook and Bishop iv. A Knight moves one square to the side and two at right angles (or visa versa). It may jump in the usual manner but may not jump across the gap between adjacent segments. The Knight 'L' move may appear flattened to a greater or lesser extent.

v. Kings may move one square in any direction and if on a square next to the centre of the board may move to any adjacent segment.

vi. A forward Pawn move is one that is at right angles to the initial Pawn line and subsequently through the side of a square that is the opposite side from which it entered. The path of a Pawn curves away at segment junctions. Pawns capture one square diagonally either side of their next step forward. The capture square will always be the same colour as the square on which they stand. Enemy Pawns always 'oppose' one another—a Pawn may not traverse an enemy line.

d) Whilst there are more than two players remaining the normal rules of chess apply with the following exceptions:

i. Kings are captured.

ii. When a side captures an opponent's King they gain control of all that side's remaining pieces.

iii. Single Checks. A check must be removed if possible by either moving the King, blocking the checking line, capturing the checking piece, pinning the checking piece against its own King or capturing the checking unit's King (at which moment the checking unit belongs to the capturing side and ceases to attack). A player who cannot so remove a check is not checkmated but is free to move another piece. Until such time as a player's King is physically removed from the board they remain in control of their army.

iv. Multiple Checks. A King may be in check from more than one opponent at any one time. A King must move so as to relieve the check from all checking units at once. If a King cannot so move the King must remain on its square and relieve one of the checks by other means (if possible). In such cases where a checked King cannot move but nevertheless has a choice of which check to parry, priority is given to the move which preserves the threatened King for the longest time. A player must defend against the opponent whose turn it is to play first; a player cannot choose which side captures their King.

v. Pinned pieces cannot check since they cannot capture.

vi. A player who cannot move misses a turn.

vii. The term 'checkmate' is saved for the final move when only two players remain.

e) When there are only two players remaining the normal rules of chess apply including that of checkmate and stalemate. Since a King need not be captured pinned pieces may check.

As such, those skilled in the art will appreciate that the conception, upon which this disclosure is based, may readily be utilised as a basis for designing other structures, methods, and systems for carrying out the several purposes of the present invention. It is important, therefore, that the scope of the invention be regarded as including such equivalent constructions.

The overall shapes of these game boards, once assembled, will take many forms depending upon the shape of each segment (more specifically the angles that the segment encloses) the number of component segments and how these segments are orientated to each other. The embodiments of the invention as disclosed are intended as examples of the genre. The invention is capable of many other embodiments and of being practised and carried out in various ways.

It will of course be understood that the invention is not limited to the specific details described herein, which are given by way of example only, and that various modifications and alterations are possible within the scope of the invention as defined by the appended claims.

I claim:

1. A board game apparatus having a playing surface which comprises pairs of removably positionable non-rectangular, quadrilateral segments which are selectively and variously configurable so as to form a plurality of board layouts for two or more players, the pairs of segments being reflective pairs having identical included angles and edge lengths.

2. A board game apparatus as claimed in claim 1, in which the segments are provided with a pattern or are otherwise suitably marked according to the requirements of a particular game.

3. A board game apparatus as claimed in claim 3, in which the pattern or marking on a first one of a segment pair is the negative reflective image of the second segment of said pair.

4. A board game apparatus as claimed in claim 1, in which the segments when assembled to form a playing surface for two, three or four players, provide a playing surface which is symmetrical in each of its mutiple player configurations.

5. A board game apparatus as claimed in claim 1, in which the area of the playing surface is proportional to the number of players for which the board layout is configured.

6. A board game apparatus as claimed in claim 1, in which the playing surface comprises four mirrored pairs of eight quadrilateral segments of which each segment encloses opposite angles of 165° and 90°, and of 60° and 45°, and in which the sides subtended by the angle of 165° are of equal length.

7. A board game apparatus as claimed in claim 1, in which the playing surface comprises three mirrored pairs of six quadrilateral segments of which each segment encloses adjacent angles of 90°, defining two parallel sides and an intermediate perpendicular side, and further angles of 60° and 12°, the perpendicular side having a length equal to half the combined length of the parallel sides.

8. A board game apparatus as claimed in claim 1, in which securing means are provided to hold the segments in their various configurations during play.

9. A board game apparatus as claimed in claim 8, in which the securing means comprises a retaining ring or collar.

10. A board game apparatus as claimed in claim 1, in which at least one of the segments includes raised lands to provide a playing surface having various levels or 'terrain' over which a playing piece operably moves.

11. A board game apparatus as claimed in claim 10, in which said at least one segment is variably profiled with crests and troughs to provide a playing surface having various levels or 'terrain' over which a playing piece operably moves.

* * * * *